US010992047B2

(12) United States Patent
Patton et al.

(10) Patent No.: US 10,992,047 B2
(45) Date of Patent: Apr. 27, 2021

(54) COMPACT FOLDED DIPOLE ANTENNA WITH MULTIPLE FREQUENCY BANDS

(71) Applicant: Neptune Technology Group Inc., Tallassee, AL (US)

(72) Inventors: Damon Lloyd Patton, Wetumpka, AL (US); Victoria Alexis Avery, Cincinnati, OH (US)

(73) Assignee: Neptune Technology Group Inc., Tallassee, AL (US)

( * ) Notice: Subject to any disclaimer, the term of this patent is extended or adjusted under 35 U.S.C. 154(b) by 40 days.

(21) Appl. No.: 16/593,367

(22) Filed: Oct. 4, 2019

(65) Prior Publication Data

US 2020/0127383 A1 Apr. 23, 2020

Related U.S. Application Data

(60) Provisional application No. 62/749,330, filed on Oct. 23, 2018.

(51) Int. Cl.

| | |
|---|---|
| ***H01Q 9/26*** | (2006.01) |
| ***H01Q 9/28*** | (2006.01) |
| ***H01Q 5/10*** | (2015.01) |
| ***H01Q 5/335*** | (2015.01) |
| ***H01Q 5/15*** | (2015.01) |
| ***H01Q 1/38*** | (2006.01) |
| ***H01Q 1/24*** | (2006.01) |

(52) U.S. Cl.

CPC ..... *H01Q 9/285* (2013.01); *H01Q 1/246* (2013.01); *H01Q 1/38* (2013.01); *H01Q 5/15* (2015.01); *H01Q 9/26* (2013.01)

(58) Field of Classification Search

CPC .. H01Q 5/15; H01Q 9/26; H01Q 5/10; H01Q 5/335; H01Q 9/285

See application file for complete search history.

(56) References Cited

U.S. PATENT DOCUMENTS

| | | | | |
|---|---|---|---|---|
| 2,640,933 A * | 6/1953 | Spindler | ..... | H01Q 5/49 343/794 |
| 2,888,678 A * | 5/1959 | Weiss | ..... | H01Q 5/49 343/814 |
| 2,980,912 A * | 4/1961 | Anderson | ..... | H01Q 5/49 343/802 |
| 4,528,568 A * | 7/1985 | Woloszczuk | ..... | H01Q 9/26 343/770 |

(Continued)

OTHER PUBLICATIONS

Zedong Wang et al. "A Broadband Dual-Element Folded Dipole Antenna With a Reflector." 750 IEEE Antennas and Wireless Propagation Letters, vol. 13, 2014, 4 pages.

(Continued)

*Primary Examiner* — Graham P Smith
*Assistant Examiner* — Jae K Kim
(74) *Attorney, Agent, or Firm* — Snyder, Clark, Lesch & Chung, LLP

(57) ABSTRACT

An antenna includes a first folded dipole, and a second folded dipole connected in parallel to the first folded dipole. The antenna further includes a conductor that extends across a first gap in the first folded dipole and a second gap in the second folded dipole to connect to a first central section of the first folded dipole and to a second central section of the second folded dipole.

20 Claims, 5 Drawing Sheets

(56) References Cited

U.S. PATENT DOCUMENTS 4,853,705 A * 8/1989 Landt ..... H01Q 1/247 343/803
5,068,672 A * 11/1991 Onnigian ..... H01P 5/10 343/859
5,322,984 A * 6/1994 Habeger, Jr. ..... B65D 81/3446 219/728
5,592,185 A * 1/1997 Itabashi ..... H01Q 3/2682 343/767
5,821,902 A 10/1998 Keen
5,917,450 A 6/1999 Tsunekawa et al.
6,317,099 B1 11/2001 Zimmerman et al.
6,650,301 B1 11/2003 Zimmerman
6,822,618 B2 11/2004 Bisiules et al.
6,956,472 B1 * 10/2005 Walcott, Jr. ..... G06K 19/07749 340/10.1
7,292,200 B2 11/2007 Posluszny et al.
8,446,331 B2 5/2013 Johnson
8,686,912 B2 4/2014 Bin Jamlus et al.
8,860,617 B1 * 10/2014 Fenick ..... H01Q 9/285 343/730
8,952,858 B2 2/2015 de Rochemont
2004/0080464 A1 * 4/2004 Suganthan ..... H01Q 5/371 343/795
2004/0222936 A1 * 11/2004 Hung ..... H01Q 5/371 343/795
2005/0073465 A1 * 4/2005 Olson ..... H01Q 5/42 343/795
2006/0071864 A1 * 4/2006 Richard ..... H01Q 1/362 343/702
2010/0097285 A1 * 4/2010 Hayashi ..... H01Q 9/28 343/803
2010/0238087 A1 * 9/2010 Jung ..... H01Q 9/26 343/810
2010/0283688 A1 * 11/2010 Kinezos ..... H01Q 9/0421 343/702
2010/0302117 A1 12/2010 Johnson
2011/0063181 A1 * 3/2011 Walker ..... H01Q 25/005 343/803
2011/0248900 A1 10/2011 de Rochemont
2011/0291836 A1 * 12/2011 Deavours ..... G06K 19/07775 340/572.7
2014/0218258 A1 * 8/2014 Walker ..... H01Q 1/007 343/848
2015/0070228 A1 * 3/2015 Gu ..... H01Q 1/2283 343/727
2016/0043473 A1 * 2/2016 Walker ..... H01Q 1/38 343/835
2016/0149293 A1 * 5/2016 Walker ..... H01Q 9/16 343/718
2018/0069291 A1 * 3/2018 Davis ..... H01Q 1/2225
2019/0393729 A1 * 12/2019 Contopanagos ..... H01Q 21/24
2020/0106184 A1 * 4/2020 Fabrega Sanchez .... H01Q 1/38

OTHER PUBLICATIONS

E. S. Pires et al. "Metamaterial-Inspired Wire Antennas." IEEE Transactions on Magnetics, vol. 49, No. 5, May 2013 1893, 4 pages.
B. H. Ahmad et al. "Dual band printed folded dipole antenna for wireless communication at 2.4 GHz and 3.5 GHz applications." 2015 Asia-Pacific Microwave Conference (APMC), Dec. 6-9, 2015, 3 pages.
Hubregt J. Visser "Printed folded dipole antenna design for rectenna and RFID applications." 7th European Conference on Anntennas and Propagation (EUCAP 2013)—Convened Sessions, 4 pages.
Makoto Sumi "Broadband folded offset fed printed dipole antenna for GSM/W-CDMA/LTE/WiFi/Bluetooth M2M applications." 2015 IEEE 4th Asia-Pacific Conference on Antennas and Propagation (APCAP), Jun. 30-Jul. 3, 2015, 2 pages.

* cited by examiner

| | Freq. | SWR |
|---|---|---|
| 1 | 809.90000 MHz | 1.9867 |
| 2 | 1.0901700 GHz | 1.9811 |
| 3 | 1.4910800 GHz | 1.9130 |
| 4 | 1.6106100 GHz | 1.8670 |

COMPACT FOLDED DIPOLE ANTENNA WITH MULTIPLE FREQUENCY BANDS

CROSS-REFERENCE TO RELATED APPLICATION

This application claims priority under 35 U.S.C. § 119, based on U.S. Provisional Application No. 62/749,330, filed Oct. 23, 2018, the disclosure of which is hereby incorporated by reference herein.

BACKGROUND

Dipole antennas are commonly used for wireless communications. A dipole antenna typically includes two identical conductive elements to which a driving current from a transmitter is applied, or from which a received wireless signal is applied to a receiver. A dipole antenna most commonly includes two conductors of equal length oriented end-to-end with a feedline connected between them. A half-wave dipole includes two quarter-wavelength conductors placed end to end for a total length (L) of approximately $L=\lambda/2$, where $\lambda$ is the intended wavelength of operation. A folded dipole antenna consists of a half-wave dipole with an additional wire connecting its two ends. The far-field emission pattern of the folded dipole antenna is nearly identical to the half-wavelength dipole, but typically has an increased impedance and a wider bandwidth. Half-wavelength folded dipoles are used for various applications including, for example, for Frequency Modulated (FM) radio antennas.

DETAILED DESCRIPTION OF THE PREFERRED EMBODIMENTS

The following detailed description refers to the accompanying drawings. The same reference numbers in different drawings may identify the same or similar elements. The following detailed description does not limit the invention.

A compact folded dipole antenna structure, as described herein, includes two parallel connected, folded dipoles formed on one side of a planar dielectric, such as a Printed Circuit Board (PCB); a feed line, a tunable frequency tuning element, and a tunable impedance matching element formed on a second, opposite side of the planar dielectric. The resulting antenna structure is compact and is also self-resonant such that the antenna structure does not need to be attached to another structure to resonate. Each of the folded dipoles of the antenna structure includes, within a gap of each folded dipole, a dipole stub that divides or bisects a respective passive, non-fed arm of each folded dipole. The frequency tuning element, formed on the side of the planar dielectric opposite the folded dipoles, extends across the length of the antenna structure and is electrically coupled to the dipole stub of each folded dipole such that the frequency tuning element electrically divides or bisects each folded dipole (i.e., electrically connects the non-fed arm of the first dipole to the non-fed arm of the second dipole). The frequency tuning element, through its electrical connections to each dipole stub and bisection of each folded dipole, effectively creates two additional folded dipoles within the antenna conductor layout. This creation of two additional folded dipoles enables the antenna structure to resonate on two separate frequency bands. The antenna structure additionally includes a tunable impedance matching element formed on a second, opposite side of the planar dielectric and which extends across a gap between respective feed sections of each of the folded dipoles. Since current is balanced in the layout of the antenna structure, no external balun needs to be used with the antenna structure. The antenna structure may also include a microstrip feed line that may be formed integrally with the antenna layout, eliminating a need for an external coaxial structure. The antenna structure described herein may be used in, for example, a meter such as a utility meter (e.g., a water meter or power usage meter). The antenna structure may be a component of a meter interface unit within the utility meter that enables primary communication with the utility meter in first frequency band and secondary communication with the utility meter in a second frequency band (e.g., for Bluetooth™ communication). The compact nature of the antenna structure, requiring use of no external components (e.g., no components on an external PCB), enables it to be fit within the physical constraints of existing meter interface units, or more easily fit within newly designed meter interface units.

Figure 1:
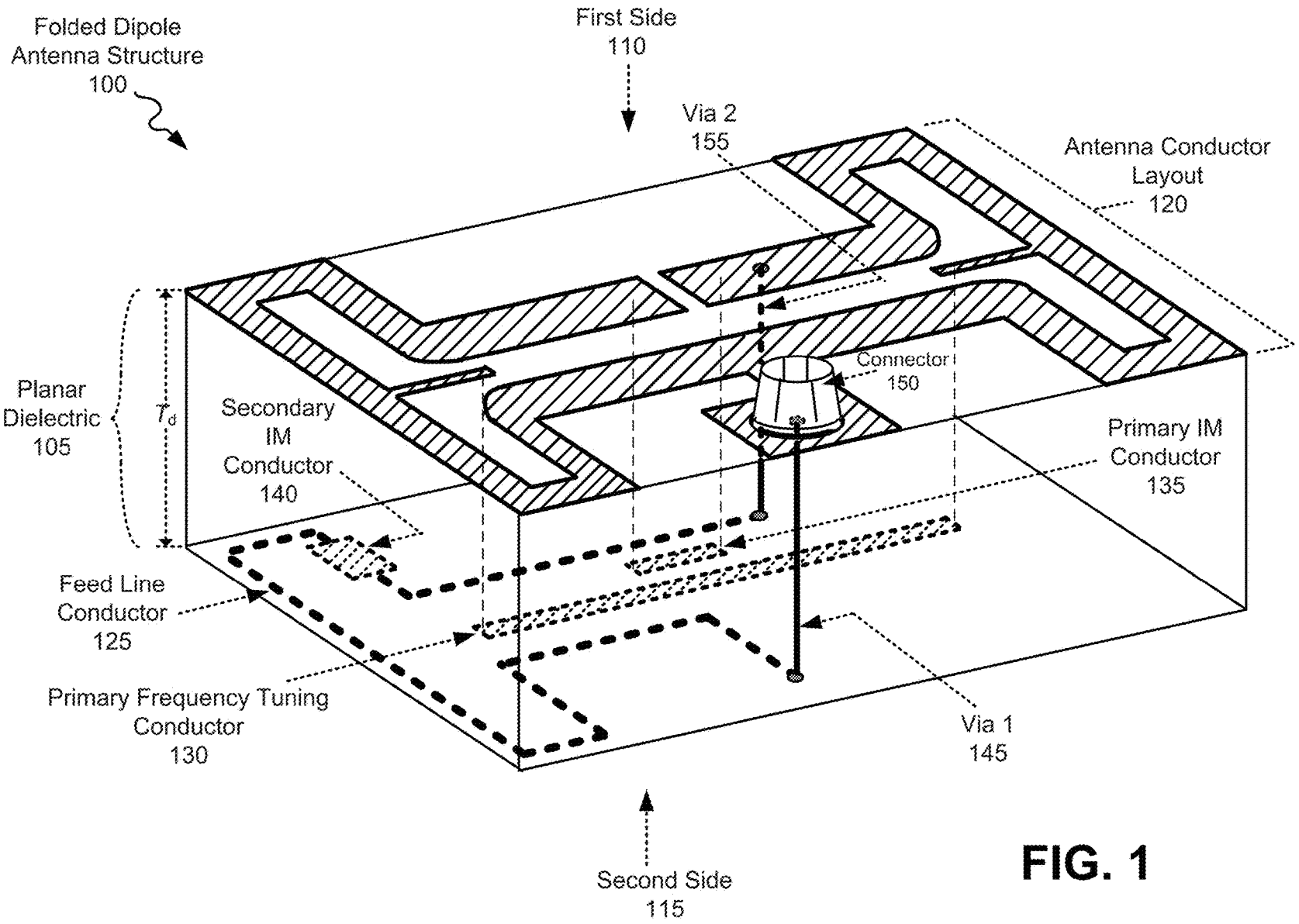
FIG. 1 depicts a three-dimensional view of a folded dipole antenna structure according an exemplary implementation.

FIG. 1 depicts a three-dimensional view of a folded dipole antenna structure 100 according to an exemplary implementation. As shown, the folded dipole antenna structure 100 includes a planar dielectric 105 having a first side 110, and an opposite, second side 115. In the example shown, first side 110 may be a "top" side and the second side 115 may be a "bottom" side. Planar dielectric 105 may include one or more of various types of dielectric material, such as, for example, fiberglass, glass, plastic, mica, and metal oxide, and may have a thickness ($T_d$) ranging from approximately 0.008 inch to about 0.24 inch. In one exemplary implementation, planar dielectric 105 may have a thickness $T_d$ of 0.032 inches. The first side 110 of planar dielectric 105 has an antenna conductor layout 120 formed upon it. The antenna conductor layout 120 forms two parallel-connected folded dipoles, as described in further detail below.

The second side 115 of planar dielectric 105 includes a feed line conductor 125, a primary frequency tuning conductor 130, and a primary impedance matching (IM) conductor 135 formed upon it. Feed line conductor 125 traces a pattern upon the second side 115 of planar dielectric 105 to connect a feed connector 150, through a via 1 145, to a feed section (described further below) of the antenna conductor layout 120. In an example in which a transmitter (not shown) transmits signals via the antenna structure 100, the transmitter signals are received by the center conductor of feed connector 150, conveyed through via 1 145 to feed line conductor 125, conveyed along a length of the feed line conductor 125, and conveyed through via 2 155 to the feed section of the folded dipoles on the first side 110 of planar dielectric 105. In an example in which a receiver (not shown) receives signals via the antenna structure 100, wireless signals received by antenna structure 100 are conveyed, via the feed section, through via 2 155, conveyed along a length of the feed line conductor 125, and conveyed through via 1 145 to the center conductor of feed connector 150. The second side 115 of planar dielectric 105 may optionally have a secondary impedance matching conductor 140 formed at a location along the length of the feed line conductor 125.

Figure 2A:
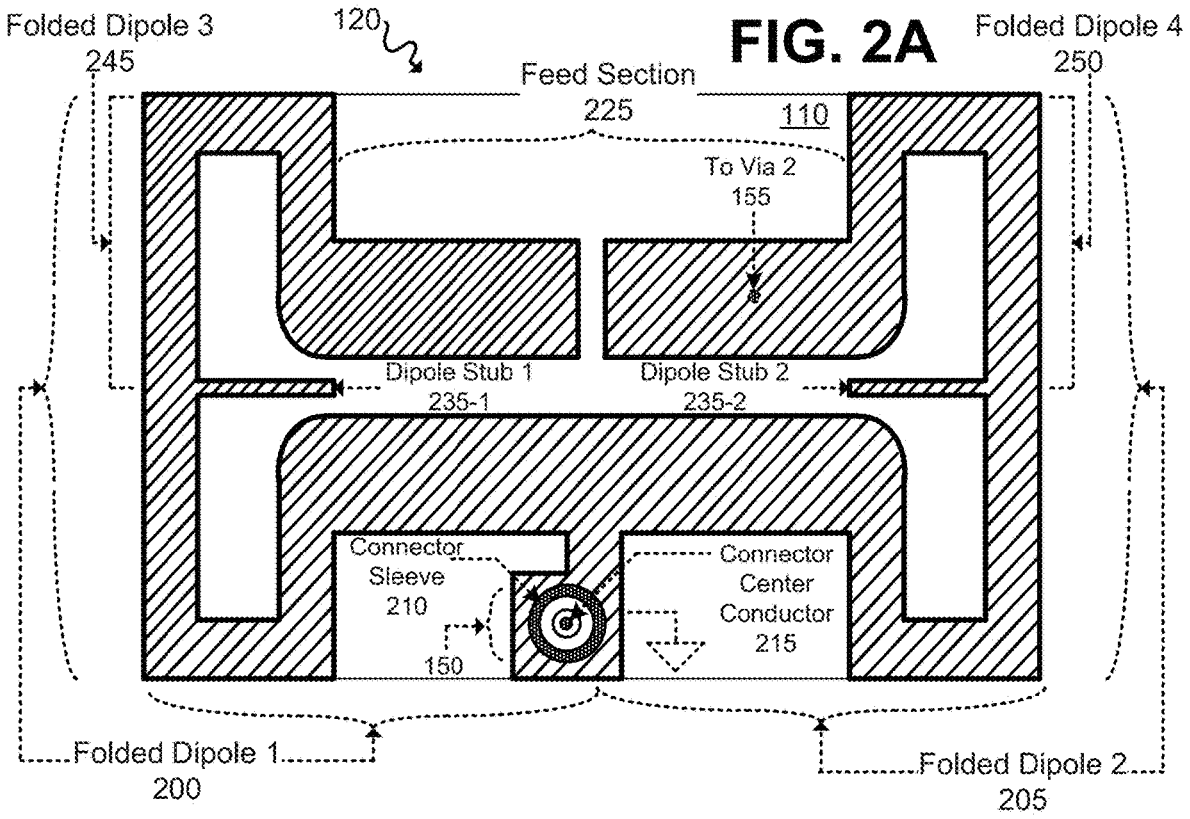
FIG. 2A depicts a two-dimensional "top" view of the first side of the antenna structure depicted in FIG. 1.
Figure 2B:
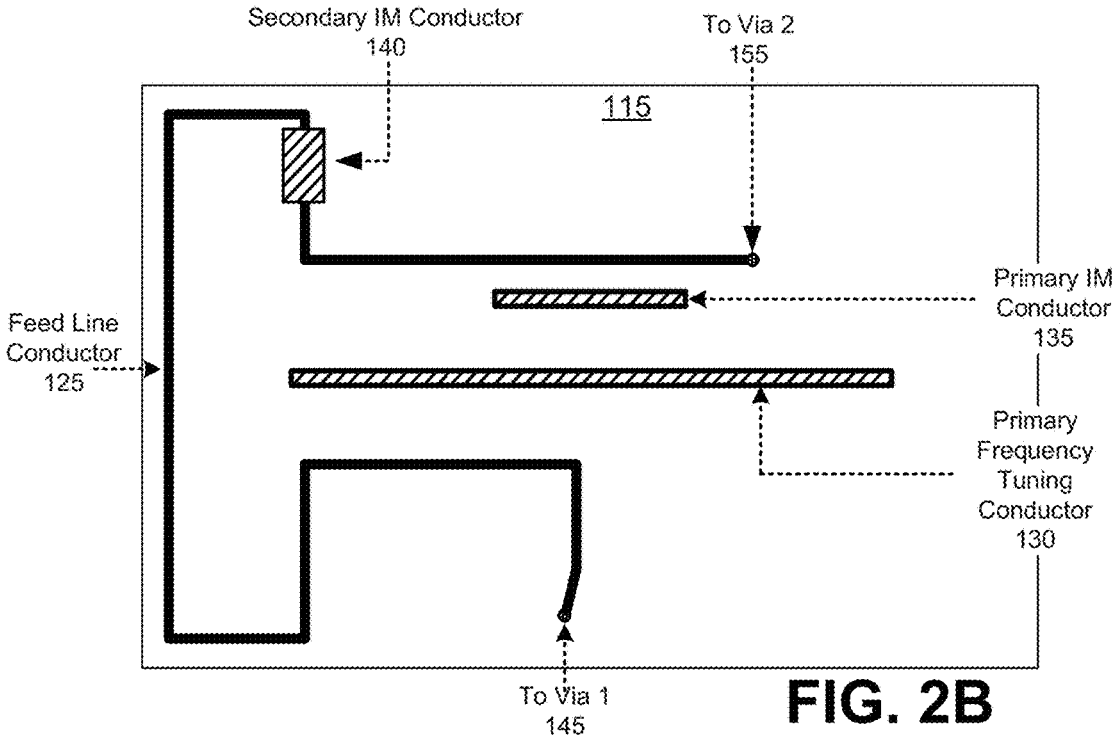
FIG. 2B depicts a two-dimensional "see-through" view of the second side of the antenna structure depicted in FIG. 1.

FIG. 2A depicts a two-dimensional "top" view of the first side 110 of antenna structure 100. FIG. 2B depicts a two-dimensional "see-through" view of the second side 115 of antenna structure 100. In the view of FIG. 2B, the material of planar dielectric 105 is depicted as transparent such that the underlying conductor layouts on the underside of planar dielectric 105 can be clearly seen. Returning to FIG. 2A, a left portion of the antenna conductor layout 120 includes a first folded dipole 200, and a right portion of the antenna conductor layout 120 includes a second folded dipole 205. As shown, feed connector 150 includes a common (e.g., ground) connection to the antenna conductor layout 120 via a connector sleeve 210 of connector 150. Both folded dipoles 200 and 205 are electrically connected to the common connection at feed connector 150. The center conductor 215 of connector 150 acts as the feed conductor and either supplies a transmitter signal (not shown) to feed line conductor 125 (FIG. 2B) through via 1 145 (not shown) or supplies a received signal from via 1 145 and feed line conductor 125 to a receiver (not shown) connected to connector 150. Feed line conductor 125 (FIG. 2B) supplies the transmitter signal through via 2 155 to a feed section 225 of the antenna conductor layout 120. Therefore, folded dipole 200 and folded dipole 205 are connected in parallel with one another between the common connection at connector 150 and the feed connection from center conductor 215 of connector 150 (i.e., through via 2 155 to feed line conductor 125, through via 2 155, to feed section 225).

As shown in FIG. 2A, folded dipole 1 200 includes a dipole stub 1 235-1 that divides an outer arm (referred to herein as the passive, non-feed arm) of dipole 1 200. Folded dipole 2 205 further includes a dipole stub 2 235-2 that divides the passive, non-feed arm of dipole 2 205. Primary frequency tuning conductor 130 (also referred to herein as "tuning element 130"), depicted in FIG. 2B, includes a length of conductor that extends over a length of the antenna conductor layout 120 on the first side 110 of planar dielectric 105. A first end of tuning element 130 (i.e., the left side in FIG. 2B) couples to dipole stub 1 235-1 across the width $T_d$ of planar dielectric 105, and a second end of tuning element 130 (i.e., the right side in FIG. 2B) couples to dipole stub 2 235-2 across the width $T_d$ of planar dielectric 105. In one exemplary implementation, each end of tuning element 130 may capacitively couple to dipole stubs 235-1 and 235-2 through the dielectric material of planar dielectric 105. In another implementation, each end of tuning element 130 may directly electrically connect to dipole stubs 235-1 and 235-2 through conductive vias (not shown) that extend through the dielectric material of planar dielectric 105. Frequency tuning element 130, via its connections to dipole stubs 235-1 and 235-2, divides folded dipole 1 200 and folded dipole 2 205 to effectively create two additional folded dipoles within the antenna conductor layout 120: folded dipole 3 245 and folded dipole 4 250 (FIG. 2A). Therefore, by the connection of tuning element 130 across dipole stubs 235-1 and 235-2, a secondary folded dipole 3 245 is created within folded dipole 1 200, and another secondary folded dipole 4 250 is created within folded dipole 2 205. Additional details regarding dimensions of the components of antenna conductor layout 120 of an exemplary implementation are described below with respect to FIG. 3.

As shown in FIG. 2B, via 1 145, which passes through the dielectric material of planar dielectric 105, electrically connects to a first end of feed line conductor 125. The feed line conductor 125 traces a circuitous pattern upon second side 115 of planar dielectric 105 that follows a portion of the pattern of antenna conductor layout 120 on the first side 110. A first end of feed line conductor 125 connects to center conductor 215 of connector 150 through via 1 145, and a second end of feed line conductor 125 connects to feed section 225 of antenna conductor layout 120 through via 2 155. A primary impedance matching conductor 135 (also referred to herein as "impedance matching element 135") extends across second side 115 of planar dielectric 105 to electrically couple the two sides of feed section 225 of antenna conductor layout 120. Primary impedance matching element 135 includes a conductive strip that extends from a first side of feed section 225 to a second side of feed section 225 to electrically couple the two sides. In one implementation, primary impedance matching element 135 may capacitively couple, across the dielectric material of planar dielectric 105, the first side of feed section 225 to the second side of feed section 225. In another implementation, two conductive vias (not shown) may extend through the planar dielectric 105 to connect a first end of impedance matching conductor/element 135 to a first side of feed section 225, and a second end of impedance matching conductor/element 135 to a second side of feed section 225. An optional secondary impedance matching conductor 140 (also referred to herein as "impedance matching element 140") may be located along the length of feed line conductor 125, as described further below with respect to FIG. 4. Additional details regarding dimensions of the various components formed on second side 115 of planar dielectric 105 of an exemplary implementation are described below with respect to FIG. 4.

Figure 3:
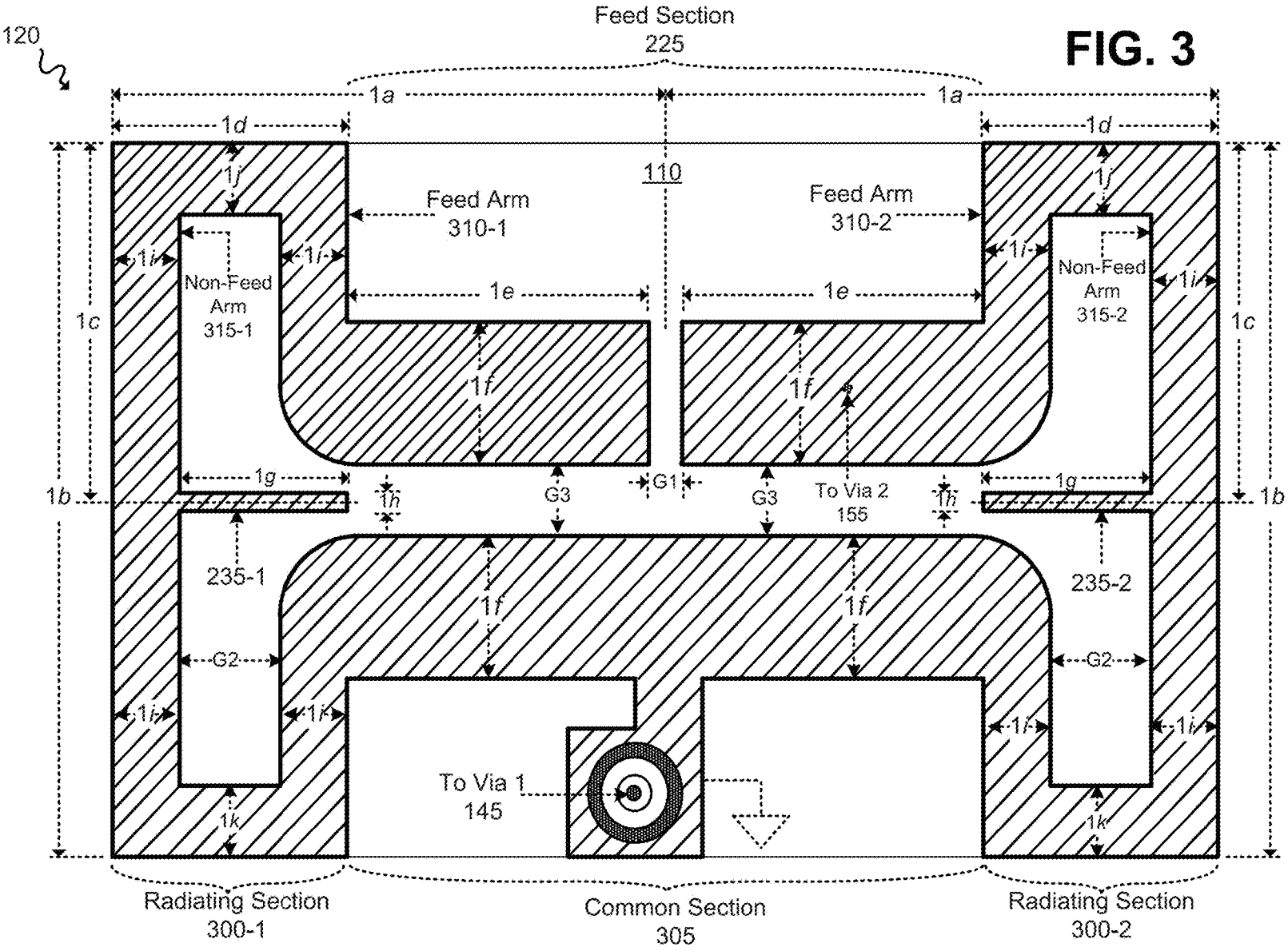
FIG. 3 depicts further details of the antenna conductor layout on the first side of the planar dielectric of FIG. 1 according to one exemplary implementation.

FIG. 3 depicts further details of antenna conductor layout 120 on first side 110 of the planar dielectric 105 according to one exemplary implementation. As shown, folded dipole 1 200 and folded dipole 2 205 (depicted in FIG. 2A) of antenna conductor layout 120 may each have a length 1*a* and a width 1*b*. In one exemplary implementation, length 1*a* may be 1.815 inches and width 1*b* may be 2.430 inches. Further, folded dipole 3 245 and folded dipole 4 250 (depicted in FIG. 2A) may each have a length 1*d* and a width 1*c*. In one exemplary implementation, length 1*d* may be 0.600 inches and width 1*c* may be 1.215 inches. Dipole stub 1 235-1 and dipole stub 235-2 may each have a length 1*g* and a width 1*h*. In one exemplary implementation, length 1*g* may be 0.419 inches and width 1*h* may be 0.040 inches As further depicted in FIG. 3, antenna conductor layout 120 includes feed section 225, a first radiating section 300-1 (corresponding to folded dipole 1 200 and folded dipole 3 245), a second radiating section 300-2 (corresponding to folded dipole 2 205 and folded dipole 4 250), and a common section 305. Feed section 225 may be divided into two sections, each having a length 1*e* and a width 1*f*, and each separated from one another by a gap G1 in the conductor material. In one exemplary implementation, the two sections of feed section 225 may have a length 1*e* of 1.170 inches, a width 1*f* of 0.440 inches, and a gap G1 of 0.060 inches. The two sections, each having a length 1*e*, of feed section 225 may be separated from common section 305 of antenna conductor layout 120 by a gap G3. In one exemplary implementation, the gap G3 may be 0.200 inches. Common section 305 may additionally have a width 1*f*, similar to width 1*f* of the two sections of feed section 225.

First radiating section 300-1 includes a feed arm 310-1 that connects to a non-feed arm 315-1. Second radiating section 300-2 includes a feed arm 310-2 that connects to a non-feed arm 315-2. Feed arms 310-1 and 310-2 connect, respectively, to each of the two feed sections having length 1*e*. Feed arms 310-1 and 310-2, and non-feed arms 315-1 and 315-2, each have a width of 1*i*. In one exemplary implementation, the width 1*i* may be 0.200 inches. Feed arm 310-1 and non-feed arm 315-1, and feed arm 310-2 and non-feed arm 315-2, are, as shown in FIG. 3, separated by a gap G2. In one exemplary implementation, the gap G2 may be 0.20 inches. Feed arm 310-1 connects to non-feed arm 315-1, and feed arm 310-2 connects to non-feed arm 315-1, with sections of conductor each having a width 1*j*. Non-feed arm 315-1 connects to common section 305, and non-feed arm 315-2 connects to common section 305 with sections of conductor each having a width 1*k*. In one exemplary implementation, width 1*j* may be 0.238 inches and width 1*k* may be 0.268 inches.

Figure 4:
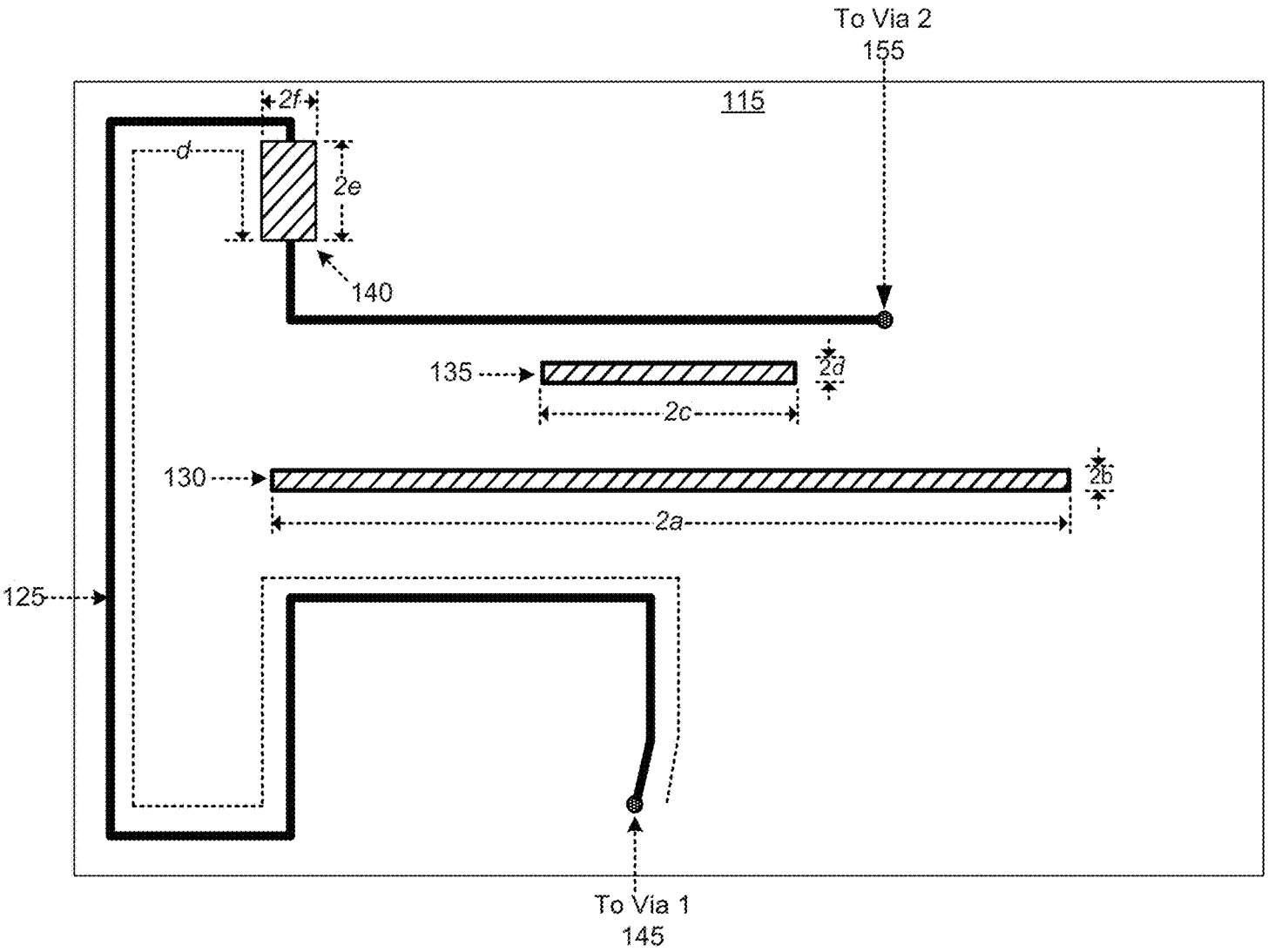
FIG. 4 depicts further details of the second side of the planar dielectric of FIG. 1 according to one exemplary implementation.

FIG. 4 depicts further details of second side 115 of the planar dielectric 105 according to one exemplary implementation. As shown, feed line conductor 125 may include a conductive strip-line that traces a path, that roughly corresponds to a shape of a portion of antenna conductor layout 120 on first side 110, from a connection with via 1 145 to a connection with via 2 155. Optional secondary impedance matching element 140, including a conductive element having a length 2*e* and a width 2*f* may be formed at a distance d from the connection to via 1 145 along the conductive strip-line of feed line conductor 125 upon second side 115. In one exemplary implementation, the distance d may be 5.903 inches, the length 2*e* may be 0.390 inches, and the width 2*f* may be 0.217 inches. The length 2*e*, width 2*f* and distance d along the conductive strip-line of feed line conductor 125 may each be selected so as to adjust the impedance of folded dipole antenna structure 100 for impedance matching.

As further shown in FIG. 4, primary frequency tuning element 130 may include a conductive element, having a length 2*a* and a width 2*b*, formed upon second side 115 such that a first end (the left side of element 130) is disposed opposite dipole stub 1 235-1 on first side 110 to enable the first end to capacitively couple to dipole stub 1 235-1 through the dielectric material of planar dielectric 105. Additionally, primary frequency tuning element 130 may be formed upon second side 115 such that a second end (the right side of element 130) is disposed opposite dipole stub 2 235-2 on first side 110 to enable the second end to capacitively couple to dipole stub 2 235-2 through the dielectric material of planar dielectric 105. Primary frequency tuning element 130, therefore, electrically couples across a length of antenna conductor layout 120 between dipole stub 1 235-1 and dipole stub 2 235-2. In one exemplary implementation, length 2*a* may be 2.360 inches and width 2*b* may be 0.040 inches. The selected length 2*a* of primary frequency tuning element 130 adjusts the fundamental frequency (i.e., frequency band 1 described below with respect to FIG. 5) of the folded dipole antenna structure 100.

FIG. 4 additionally depicts primary impedance matching element 135, including a conductive element having a length 2*c* and a width 2*d*, formed upon second side 115 such that a first end (the left side of element 135) is disposed opposite the left section of feed section 225 of antenna conductor layout 120 to enable the first end to capacitively couple to the left end of feed section 225 through the dielectric material of planar dielectric 105. Additionally, primary impedance matching element 135 may be formed upon second side 115 such that a second end (the right side of element 135) is disposed opposite the right section of feed section 225 of antenna conductor layout 120 to enable the second end to capacitively couple to the right end of feed section 225 through the dielectric material of planar dielectric 105. Primary impedance matching element 135, therefore, electrically couples across gap G1 (FIG. 3) between the two separate sections of feed section 225 of antenna conductor layout 120. In one exemplary implementation, length 2*c* may be 0.500 inches and width 2*d* may be 0.050 inches. The length 2*c* of primary impedance matching element 135 may be selected so as to adjust the impedance of folded dipole antenna structure 100.

Figure 5:
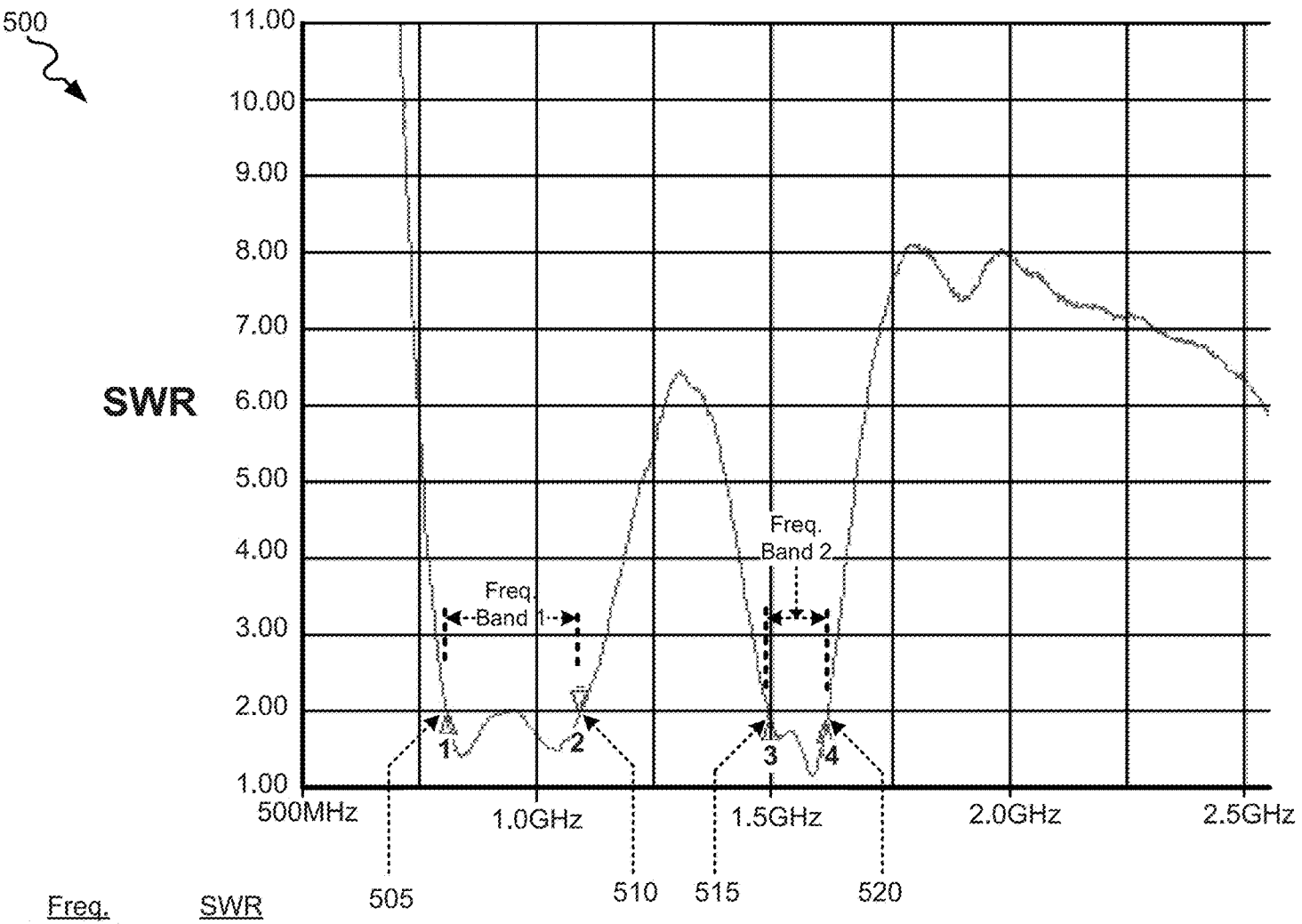
FIG. 5 depicts a plot of Voltage Standing Wave Ratio versus frequency for an exemplary folded dipole antenna structure corresponding to FIG. 1.

FIG. 5 depicts a plot 500 of Voltage Standing Wave Ratio (VSWR) versus frequency for the exemplary implementation of the folded dipole antenna structure 100 described herein. The x-axis of the plot 500 includes frequency, ranging from 500 MegaHertz (MHz) to 2.5 GigaHertz (GHz). The y-axis of the plot 500 includes VSWR, ranging from 1.00 to 11.00. As is understood in the art, for a transmitter to deliver power to an antenna, or receive power from the antenna, the impedance of the transmitter/receiver and the transmission line must be well matched to the antenna's impedance. The VSWR parameter of an antenna numerically measures how well the antenna is impedance matched to the transmitter/receiver. The smaller an antenna's VSWR is, the better the antenna is matched to the transmitter/receiver and the transmission line, and the more power is delivered to/from the antenna. The minimum VSWR of an antenna is 1.0, at which no power is reflected from the antenna. Bandwidth requirements of antennas are typically expressed in terms of VSWR. For example, an antenna for a particular application x may need to operate from 1.0 GHz to 1.3 GHz with a VSWR less than 3.0.

In the plot 500 of FIG. 5, the plotted VSWR indicates that the exemplary implementation of the folded dipole antenna structure 100 described herein has at least two separate frequency bands at which the VSWR is 2.0 or lower. The first frequency band (frequency band 1) spans from the lower frequency of 809.9 MHz at the number "1" 505 to the higher frequency of 1.09 GHz at the number "2" 510. The second frequency band (frequency band 2) spans from the lower frequency of 1.491 GHz at "3" 515 to the higher frequency of 1.61 GHz at "4" 520. The first frequency band could be used for primary communications, and the second frequency band could be used for secondary communications. The antenna's impedance is, therefore, well matched to the transmitter/receiver and the transmission line within frequency band 1 and frequency band 2 shown in FIG. 5. One skilled in the art will recognize, however, that the frequency bands depicted in FIG. 5 may be changed based on changing the dimensions of the antenna structure 100, such as changing lengths of 1*a*, 1*b*, 1*c*, 1*d*, and/or 2*a* of the antenna conductor layout 120. For example, the dimensions of the antenna structure 100 may be modified such that the second frequency band could be used for Bluetooth™ communications (e.g., spanning a range from 2.400-2.485 GHz).

The foregoing description of implementations provides illustration and description, but is not intended to be exhaustive or to limit the invention to the precise form disclosed. Modifications and variations are possible in light of the above teachings or may be acquired from practice of the invention. For example, various antenna patterns have been shown and various exemplary dimensions have been provided. It should be understood that different patterns and/or dimensions may be used than those described herein. Various dimensions associated with antenna conductor layout 120, planar dielectric 105, feed line conductor 125, frequency tuning element 130, and impedance matching elements 135 and 140 have been provided herein. It should be understood that different dimensions of the conductor elements and the dielectric, such as different lengths, widths, thicknesses, etc., may be used than those described herein. The resonant frequencies, and antenna impedance, of antenna structure 100 may be adjusted based on varying the relative lengths, widths, and/or thickness of the antenna components described herein.

Certain features described above may be implemented as "logic" or a "unit" that performs one or more functions. This logic or unit may include hardware, such as one or more processors, microprocessors, application specific integrated circuits, or field programmable gate arrays, software, or a combination of hardware and software.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. An antenna, comprising:

a first folded dipole;

a second folded dipole connected in parallel to the first folded dipole; and a conductor that extends across a first gap in the first folded dipole and a second gap in the second folded dipole to couple to a first central section of the first folded dipole and to a second central section of the second folded dipole.

2. The antenna of claim 1, wherein a length of the conductor determines a primary frequency of the antenna.

3. The antenna of claim 1, wherein a first end of the conductor couples to a first dipole stub of the first folded dipole and a second end of the conductor couples to a second dipole stub of the second folded dipole.

4. The antenna of claim 3, further comprising:

a planar dielectric, wherein the first folded dipole and the second folded dipole are formed on a first side of the planar dielectric and wherein the conductor is formed on a second side of the planar dielectric.

5. The antenna of claim 4, wherein the first end of the conductor capacitively couples to the first dipole stub across the planar dielectric and wherein the second end of the conductor capacitively couples to the second dipole stub across the planar dielectric.

6. The antenna of claim 1, wherein the first folded dipole includes a first feed arm and a first non-feed arm, wherein the first non-feed arm includes the first central section, and wherein a first dipole stub connects to the central section of the first non-feed arm, and wherein the second folded dipole includes a second feed arm and a second non-feed arm, wherein the second non-feed arm includes the second central section, and wherein a second dipole stub connects to the central section of the second non-feed arm.

7. The antenna of claim 4, further comprising:

a feed conductor line, formed on the second side of the planar dielectric, that connects to a feed section of the first and second folded dipoles.

8. The antenna of claim 7, further comprising:

an impedance matching element formed at a location along a length of the feed conductor line.

9. The antenna of claim 4 further comprising:

an impedance matching element, formed on the second side of the planar dielectric, that electrically couples to a feed section of the first and second folded dipoles.

10. The antenna of claim 1, further comprising:

a third folded dipole formed within the first folded dipole and a fourth dipole formed within the second folded dipole due to the conductor coupling to the central section of the first folded dipole and to the central section of the second folded dipole.

11. An antenna structure, comprising:

a planar dielectric;

a conductor layout formed on a dielectric, wherein the conductor layout forms a first folded dipole coupled in parallel to a second folded dipole;

a feed line conductor formed on the dielectric;

a first conductor, formed on the dielectric, that couples to the first folded dipole at a first end of the first conductor and to the second folded dipole at a second end of the first conductor; and a second conductor formed on the dielectric across a first gap between the first folded dipole and the second folded dipole.

12. The antenna structure of claim 11, wherein the second conductor comprises an impedance matching element for the antenna structure.

13. The antenna structure of claim 11, wherein the dielectric comprises a planar dielectric, wherein the conductor layout is formed on a first side of the planar dielectric, and wherein the feedline conductor, the first conductor, and the second conductor are formed on a second side of the planar dielectric that is opposite to the first side.

14. The antenna structure of claim 11, wherein a length of the first conductor determines a primary frequency of the antenna structure.

15. The antenna structure of claim 11, wherein the first conductor extends across a second gap in the first folded dipole and a third gap in the second folded dipole to couple across a first central section of the first folded dipole and a second central section of the second folded dipole.

16. The antenna structure of claim 15, further comprising:

a third folded dipole formed within the first folded dipole and a fourth folded dipole formed within the second folded dipole due to the first conductor connecting across the central section of the first folded dipole and the central section of the second folded dipole.

17. The antenna structure of claim 11, further comprising:

a third conductor formed at a location along a length of the feed line conductor.

18. The antenna structure of claim 17, wherein the third conductor comprises an impedance matching element of the antenna structure.

19. The antenna structure of claim 11, wherein the first folded dipole includes a first dipole stub and the second folded dipole includes a second dipole stub, and wherein the first end of the first conductor couples to the first dipole stub and the second end of the first conductor couples to the second dipole stub.

20. An antenna structure included in a utility meter, comprising:

a planar dielectric;

a conductor layout formed on a first side of the planar dielectric, wherein the conductor layout forms a first folded dipole connected in parallel to a second folded dipole;

a feed line conductor formed on a second side of the planar dielectric, opposite to the first side;

a first impedance matching conductor formed on the second side of the planar dielectric; and a first frequency tuning conductor formed on the second side of the planar dielectric, wherein the first folded dipole includes a first dipole stub and the second folded dipole includes a second dipole stub, and wherein a first end of the first frequency tuning conductor capacitively couples to the first dipole stub through the planar dielectric and a second end of the first frequency tuning conductor capacitively couples to the second dipole stub through the planar dielectric.

* * * * *